US012757955B2

(12) United States Patent
Maman

(10) Patent No.: US 12,757,955 B2
(45) Date of Patent: Oct. 13, 2026

(54) HAIR EXTENSION ATTACHMENT TOOL

(71) Applicant: ZIP LOXX, LLC, Edgewood, NY (US)

(72) Inventor: Priel Maman, Ft. Lauderdale, FL (US)

(73) Assignee: ZIP LOXX, LLC, Edgewood, NY (US)

( * ) Notice: Subject to any disclaimer, the term of this patent is extended or adjusted under 35 U.S.C. 154(b) by 487 days.

(21) Appl. No.: 17/839,342

(22) Filed: Jun. 13, 2022

(65) Prior Publication Data

US 2022/0330639 A1 Oct. 20, 2022

Related U.S. Application Data

(63) Continuation of application No. PCT/US2021/014884, filed on Jan. 25, 2021.

(60) Provisional application No. 62/965,538, filed on Jan. 24, 2020.

(51) Int. Cl.
*A41G 5/00* (2006.01)

(52) U.S. Cl.
CPC ..... *A41G 5/0046* (2013.01); *A41G 5/0073* (2013.01)

(58) Field of Classification Search
CPC ..... A45D 8/20; A45D 19/012; A45D 19/106; A41G 5/0046; A41G 5/0073; A41G 5/0086
See application file for complete search history.

(56) References Cited

U.S. PATENT DOCUMENTS 6,263,886 B1 * 7/2001 Davis ..... A45D 8/20 132/273
10,010,125 B1 * 7/2018 Maman ..... A41G 5/00
2005/0092341 A1 * 5/2005 Padilla ..... A41G 5/0073 132/201
2012/0298129 A1 * 11/2012 Balboa ..... A45D 8/30 132/277
2014/0290680 A1 * 10/2014 Webster ..... A45D 24/10 132/129

FOREIGN PATENT DOCUMENTS

DE 10134782 A1 * 5/2002
JP 2002138316 A * 5/2002 ..... A41G 5/0086

OTHER PUBLICATIONS

DE10134782A1 computer translation (Year: 2025).*

* cited by examiner

*Primary Examiner* — Rachel R Steitz
(74) *Attorney, Agent, or Firm* — Barnes & Thornburg

(57) ABSTRACT

A tool for integrating a hair extension with a person's head of hair is described in this disclosure. The hair extension attachment tool illustratively includes a clamp body and a parting needle that provides means for assisting in removeably coupling the hair extension to natural hairs included in the person's head of hair.

6 Claims, 5 Drawing Sheets

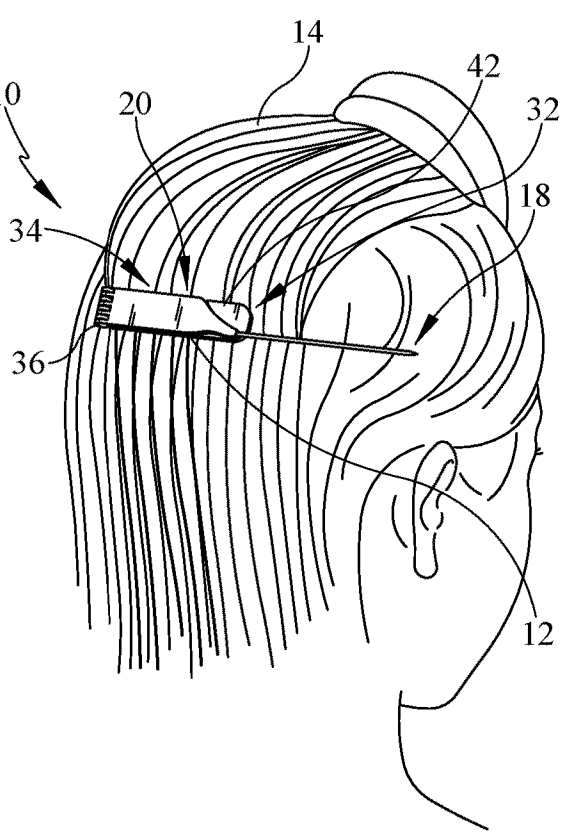
FIG. 1
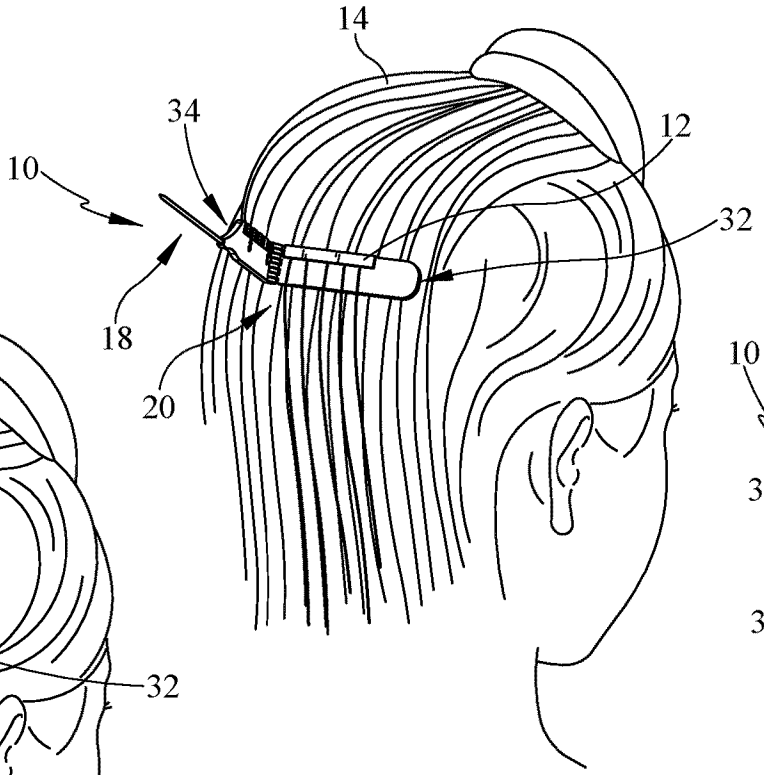
FIG. 2
FIG. 3

HAIR EXTENSION ATTACHMENT TOOL

CROSS REFERENCE TO RELATED APPLICATIONS

This application is a continuation of International Application No. PCT/US2021/14884, filed on Jan. 25, 2021, which claims priority to and the benefit of U.S. Provisional Patent Application No. 62/965,538, filed 24 Jan. 2020, the disclosures of both priority applications are expressly incorporated herein by reference.

BACKGROUND

Hair extensions are used to add length or fullness to a person's natural head of hair for cosmetic reasons and are often coupled to the natural hair using an attachment tool. The hair extensions include supplemental hairs from another human head or from synthetic sources to augment natural hairs on a person's head. The supplemental hairs are integrated into a person's natural head of hair using one of a number of methods and/or tools. However, many of these methods and attachment tools can be time consuming, costly, difficult to use, and/or damaging to a person's natural head of hair.

SUMMARY

An attachment tool for integrating a hair extension into a person's head of hair is described in this disclosure. The hair extension attachment tool includes a clamp body and a parting needle for attaching the hair extension to a person's head of natural hairs.

In illustrative embodiments, the clamp body includes a substantially rigid connector panel and a substantially rigid engagement panel that provides a means for removeably coupling the hair extension to natural hairs included in the person's head of hair. The clamp body couples the hair extension to natural hairs included in the person's head of hair in response to pressure applied upon the substantially rigid engagement panel which is conveyed to the connector panel and the hair extension positioned therebetween.

In illustrative embodiments, the clamp body includes a plurality of depressions and a plurality of ridges formed in a top edge thereof. In such embodiments, at least some of the hair extension engages with the plurality of depressions and the plurality of ridges so to couple the hair extension to the wearer's natural hair.

In illustrative embodiments, the hair extension attachment tool includes a substantially elbow by which the connector panel and engagement panel are coupled. More specifically the elbow couples the engagement panel to the connector panel for pivoting movement relative to the connector panel about an axis.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is a rear elevation view of a person's head of natural hair and a hair extension attachment tool in a partially open position showing that the hair extension attachment tool includes a clamp body and a parting needle for assisting in coupling a hair extension to a person's head of natural hair;

FIG. 2 is a rear elevation view of the person's head of natural hair and the hair extension attachment tool of FIG. 1 showing the hair extension attachment tool with a hair extension positioned therein and both in a partially open position in preparation for coupling the hair extension to the person's head of natural hair;

Figure 4:
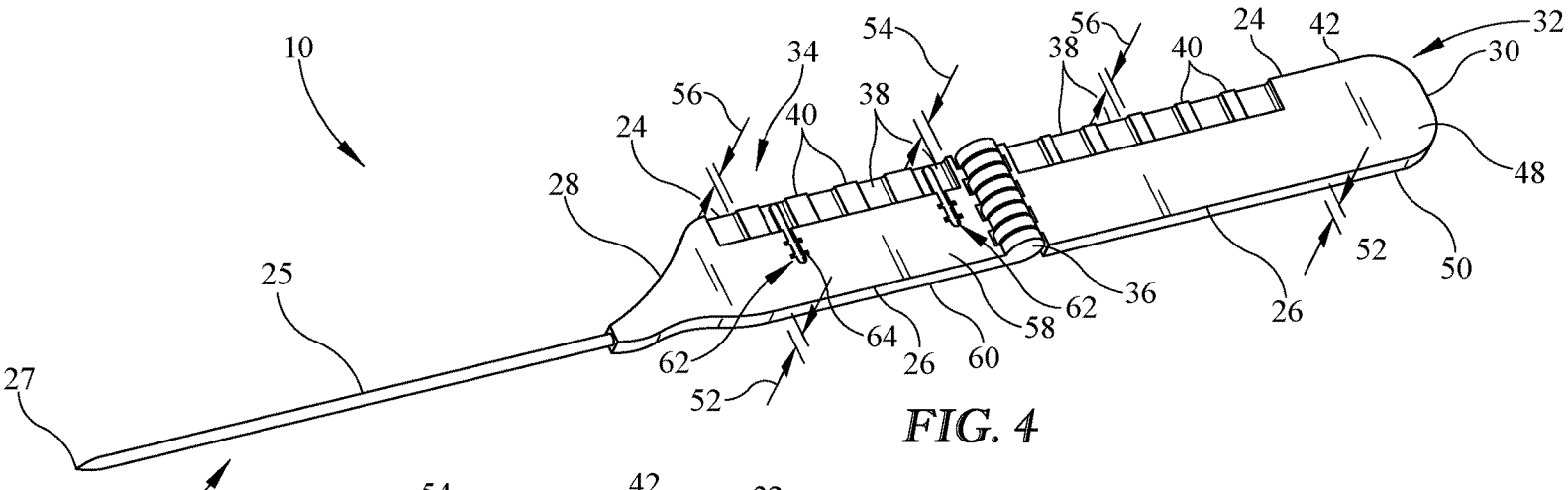
Figure 5:
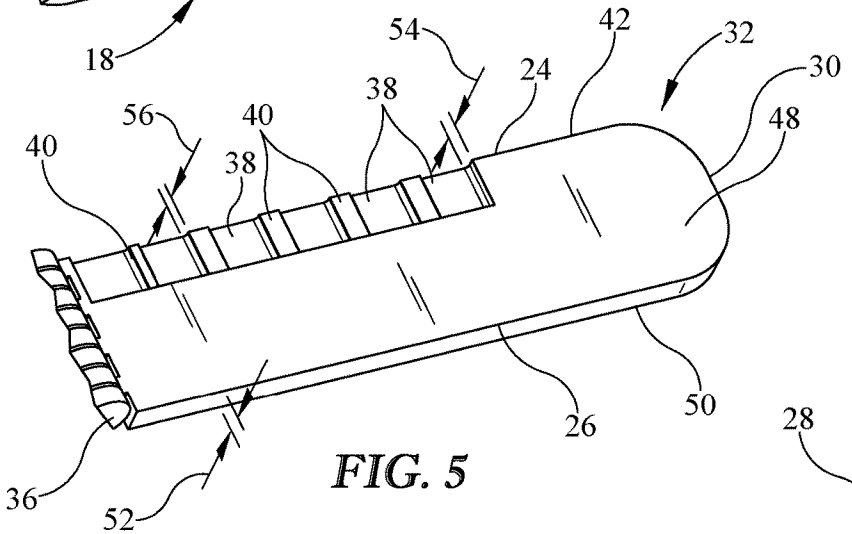
Figure 6:
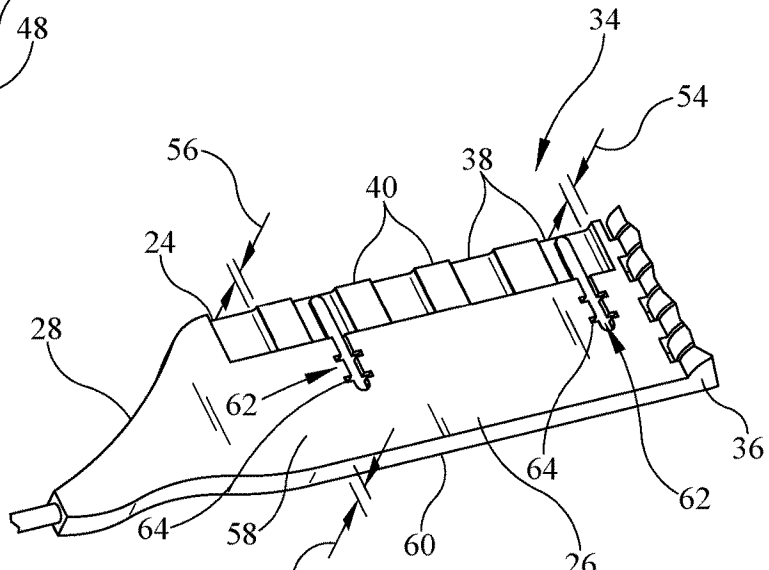
Figure 7:
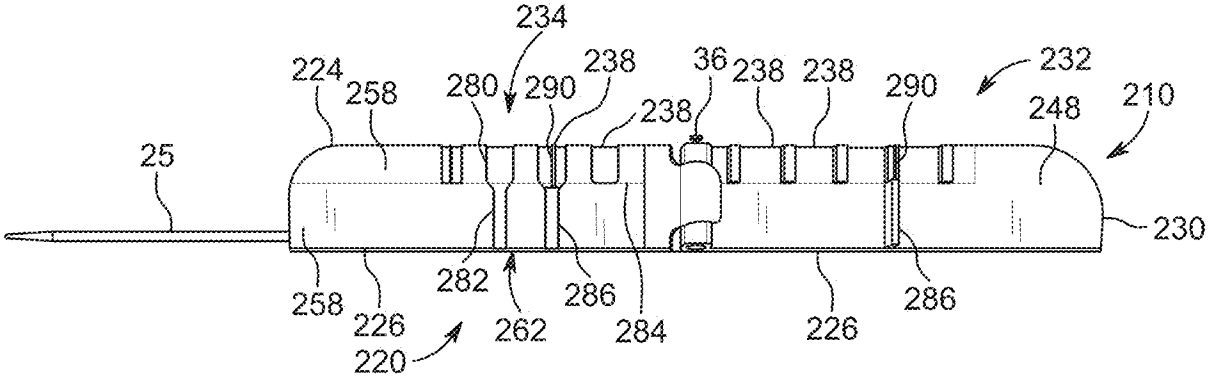
Figure 9:
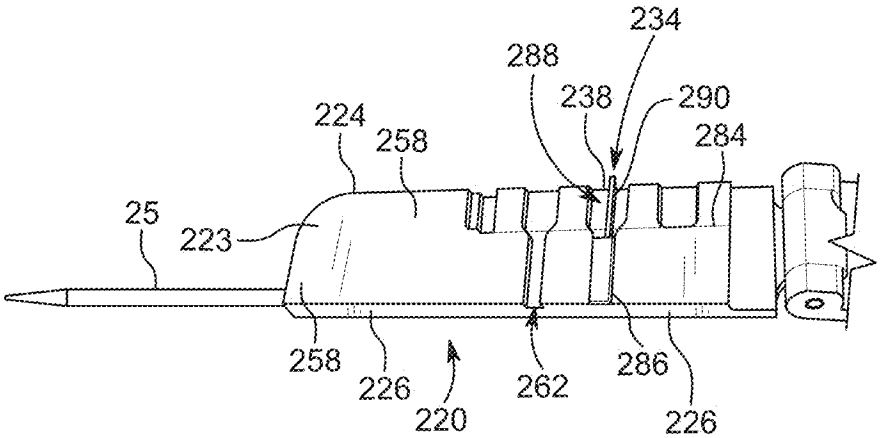
Figure 8:
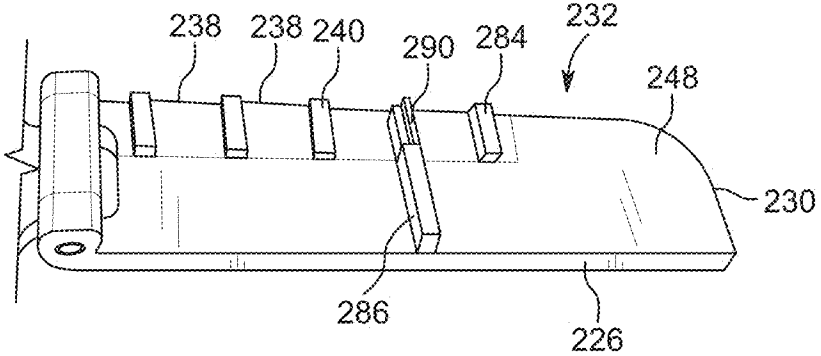
Figure 10:
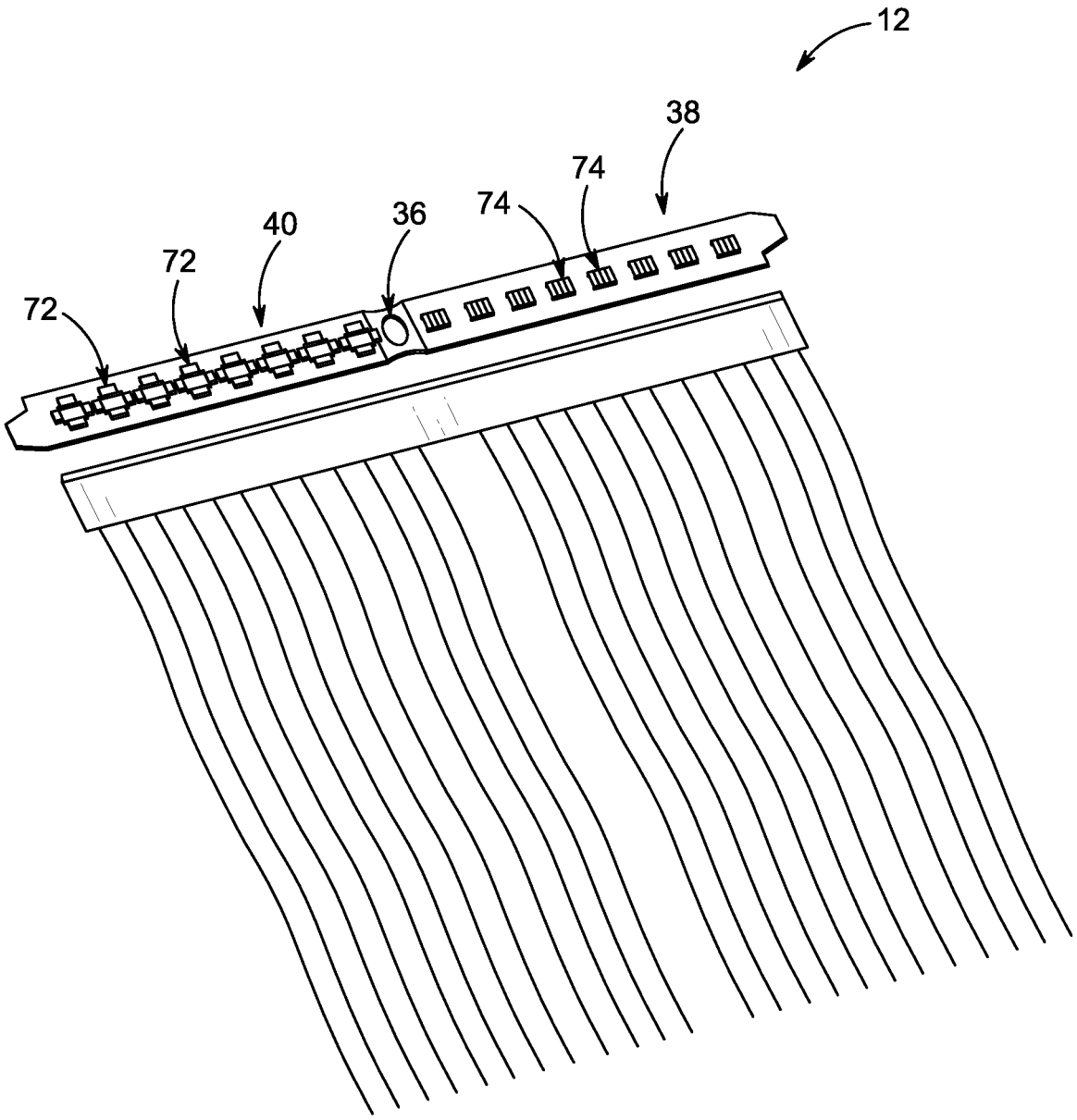
Figure 11:
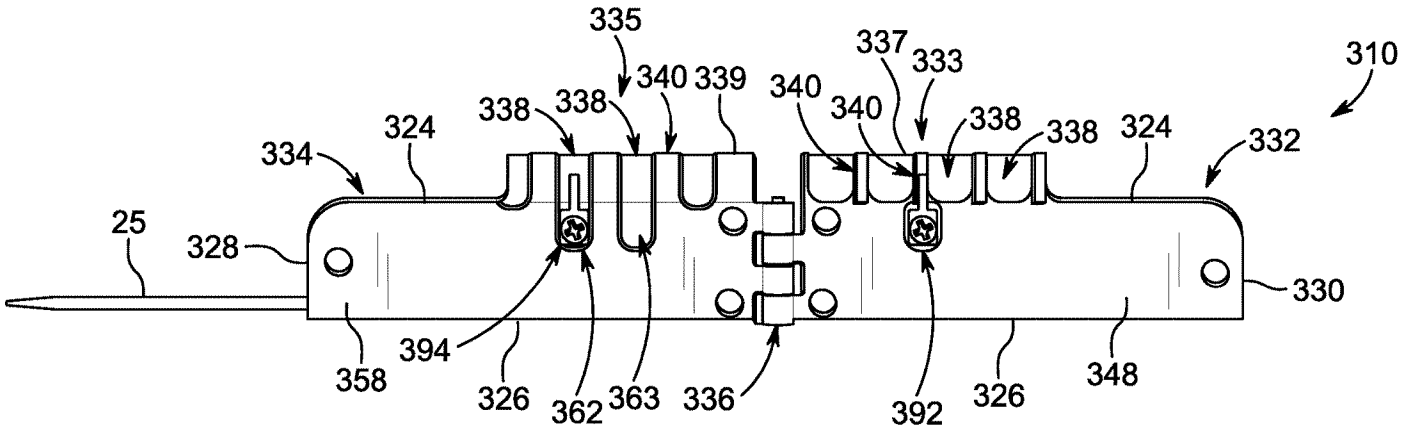
Figure 13:
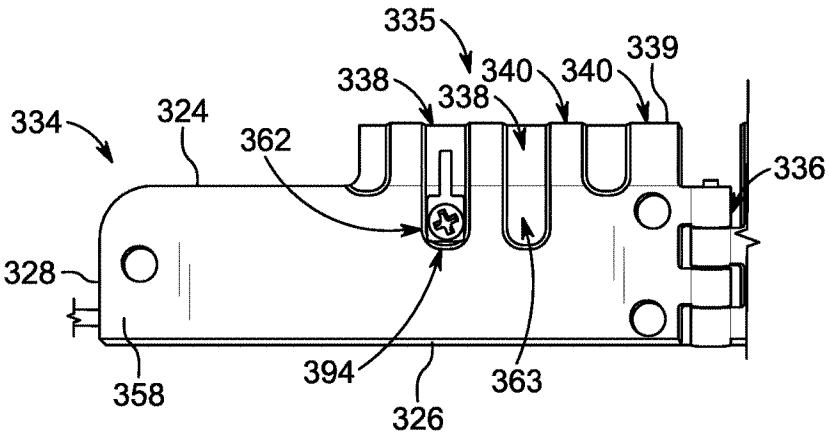
Figure 12:
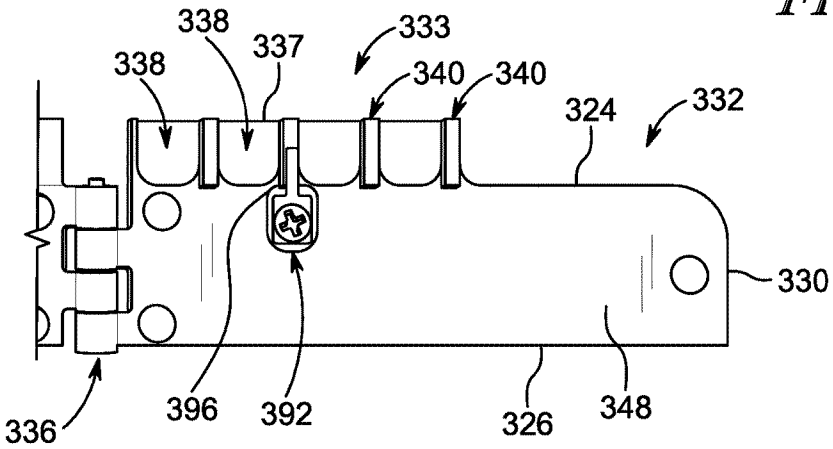

FIG. 3 is a rear elevation view of the person's head of natural hair and the hair extension attachment tool of FIGS. 1-2 showing the hair extension positioned therein with both the hair extension attachment tool and the hair extension in a closed position and coupled to the person's head of natural hair with the hair attachment tool prepared to be moved into an open position and removed from the person's head of natural hair such that the hair extension remains coupled to the person's head of natural hair upon removal thereof;

FIG. 4 *a* is a perspective view of the hair extension attachment tool of FIGS. 1-3 showing that the hair extension attachment tool includes the parting needle and the clamp body and showing that the clamp body includes a connector panel and an engagement panel adapted to receive the hair extension and to couple the hair extension to the wearer's natural head of hair in a closed position and showing a tether or elbow that extends from the connector panel to the engagement panel;

FIG. 5 is a detail perspective view of the connector panel showing a plurality of connector ridges defining a plurality of connector depressions sized to receive a portion of the hair extension when the hair extension is positioned therein;

FIG. 6 is a detail perspective view of the engagement panel included showing a plurality of engagement ridges defining a plurality of engagement depressions sized to receive a portion of the hair extension when the hair extension is positioned therein;

FIG. 7 is a perspective view of a second embodiment of the hair extension attachment tool showing a connector panel and an engagement panel;

FIG. 8 is a detail perspective view of the second embodiment of the hair extension attachment tool of FIG. 7 showing a connector panel;

FIG. 9 is a detail perspective view of the second embodiment of the hair extension attachment tool of FIGS. 7-8 showing an engagement panel;

FIG. 10 is a perspective view of the hair attachment configured to be used in conjunction with the hair extension attachment tool;

FIG. 11 is a perspective view of a third embodiment of the hair extension attachment tool showing a connector panel and an engagement panel;

FIG. 12 is a detail perspective view of the third embodiment of the hair extension attachment tool of FIG. 11 showing the connector panel; and FIG. 13 is a detail perspective view of the third embodiment of the hair extension attachment tool of FIGS. 11-12 showing the engagement panel.

DETAILED DESCRIPTION

A hair extension attachment tool 10 according to the present disclosure is adapted to integrate a hair extension 12 into a person's natural hair 14 such that hair extension 12 adds length or fullness to the person's natural hair 14 as suggested in FIGS. 1-3. More specifically, the hair extension attachment tool 10 is configured for use with hair extension 12 like those described in PCT Patent Application WO 2018/187468, which is incorporated by reference in this disclosure. Such hair extensions are available under the brand name Zip Loxx. However, the tool 10 described herein may be used with other hair extension designs. The combination of the hair extension attachment tool 10 and the hair extension 12 provide a hair enhancement system or kit 15.

Hair Extension attachment tool 10 includes a parting needle 18 and a clamp body 20 coupled thereto as shown in FIGS. 1-3. Parting needle 18 is configured to split a portion of a person's head of hair 16 into an upper section and lower section, thereby creating a part, such that the hair extension attachment tool 10 may be positioned therebetween. Clamp body 20 is configured to cooperate with hair extension 12 to couple hair extension 12 to plurality of natural hairs 14 included in a person's head of hair 16 mechanically without the use of adhesives.

Hair extension attachment tool 10 is illustratively rigid so as to assist in coupling a flexible hair extension 12 to the person's natural hairs 16 as suggested in FIGS. 1-3. Hair extension attachment tool 10 is illustratively a two piece component but may also be formed from a monolithic, one-piece component that flexes.

Hair extension attachment tool 10 is formed to include a substantially or fully rigid connector panel 32, a substantially or fully rigid engagement panel 34, and an elbow 36 interconnecting the panels 32, 34 as shown best in FIG. 4. Hair extension attachment tool 10 is moved from an opened position (FIGS. 1, 2, and 4) to a closed position (FIG. 3) by a user positioning engagement panel 34 on top of connector panel 32 while hair extension 12 and some of the wearer's natural hair 14 are positioned between engagement panel 34 and connector panel 32 causing natural hairs 14 and hair extension 12 to be coupled together with hair extension 12 in a closed, locked position.

The hair extension attachment tool 10 allows for hair extension 12 to be locked in a closed position while wearer's natural hair 16 are positioned between connector panel 32 and engagement panel 34, as shown in FIG. 3. Accordingly, hair extension attachment tool 10 assists the attachment means of hair extension 12 for coupling hair extension 12 to wearers' natural hair 14 so that the hair extension 12 is removeably coupled to wearer's natural hairs 14.

Clamp body 20 is illustratively formed from a substantially or fully rigid material and is defined by an upper edge 24, a lower edge 26 positioned opposite to and spaced apart from a upper edge 24, a first side 28 extending between and coupled to upper edge 24 and lower edge 26, and a second side 30 positioned opposite to and spaced apart from first side 28 and extending between and coupled to upper edge 24 and lower edge 26. Illustratively, upper edge 24 is formed to be positioned at the part formed by the parting needle 18 in the person's natural hair 14. Further, as shown in FIGS. 1-4, clamp body 20 is coupled to parting needle 18 at first side 28 of clamp body 20.

Parting needle 18 of hair extension attachment tool IO is defined by an extension 25 formed from a substantially or fully rigid material and extends between a free end 27 configured to part the person's natural hair 16 to the first side 28 of clamp body 20. Illustratively, free end 26 is formed as a tip/point and configured to slide through the person's natural hair 14 to form the aforementioned part for placement of the hair attachment tool IO therein. Parting needle 18 is coupled to clamp body 20 such that upon parting the wearer's hair 14, clamp body 20 is configured to be positioned therein and prepared to receive hair extension 12 and some of the wearer's natural hair 14 for coupling thereto.

Clamp body 20 is further formed to include a connector panel 32, an engagement panel 34 spaced therefrom, and a hinge/elbow 36 positioned between and coupled to both connector panel 32 and engagement panel 34. Connector panel 32 is defined by upper edge 24, lower edge 26, second side 30, and elbow 36. Engagement panel 34 is defined by upper edge 24, lower edge 26, first side 28, and elbow 36. Illustratively, parting needle 18 extends from engagement panel 34 at first side 28.

Connector panel 32 of the hair extension tool 10 is designed to be placed nearest the head of the wearer 16 and configured to receive hair extension 12 as suggested in FIG. 2. In some embodiments, connecter panel 32 may receive only a portion of hair extension 12. Connector panel 32 is formed to include a support surface 48 and an outer surface 50 positioned opposite support surface 48 and extending between edges 24, 26, second side 30, and elbow 36. Support surface 48 is configured to engage hair extension 12 and is formed to include a plurality of depressions 38 defined by a plurality of ridges 40 extending between elbow 36 to an opener tab 42 formed in support surface 48 along upper edge 24 as shown in FIGS. 4 and 5. Outer surface 50 is formed to be nearest the natural hair of the wearer 14. Illustratively, depressions 38 and ridges 40 extend a majority of upper edge 24 connector panel 32. Opener tab 42 is defined by second side 30 and upper edge 24 and extends from the second side 30 of connector panel 32 over only a portion of the height of the connector panel 32 to provide a grip for a user pulling the engagement panel 34 away from connector panel 32 once hair extension 12 is coupled to wearer's natural hair 16.

A majority of support surface 48 of connector panel 32 is sized to extend a consistent height 52 from outer surface 50 along its length, as shown in FIGS. 4 and 5. The portion of support surface 48 having plurality of depressions 38 and ridges 40 formed therein is sized to extend a height 54 from outer surface 50 which is less than the aforementioned previous consistent height 52. Depressions 38, illustratively, have the same height 54 are u-shaped, although other shapes may be used and are contemplated herein. Ridges 40 extend beyond the height 54 of the depressions 38 and are illustratively sized to be a height 56 between that of the consistent height 52 of support surface 48 and the height 54 of the depressions 38.

Depressions 38 are defined between ridges 40, as shown in FIGS. 4-5, and configured to engage hair extension 12 to assist in closure thereof, as shown in FIG. 2. Illustratively, six depressions 38 are formed in support surface 48 such that most are sized similarly. The depression 38 positioned nearest elbow 36 is sized smaller than the other depressions 38, in the illustrative embodiment. Plurality of depressions 38 are configured to engage a portion of hair extension 12 upon moving hair extension 12 into a closed position having some natural hair positioned therein, as shown in FIG. 2.

Ridges 40 are, illustratively, rectangular in shape and formed to engage hair extension 12 such that once some of the wearer's natural hair 16 is positioned therein and hair extension 12 is in a closed position, as shown in FIG. 2, plurality of ridges 40 are located behind and in contact with hair extension 12. Illustratively, five ridges 40 are formed in support surface 48 such that most are sized similarly. The ridge 40 positioned nearest elbow 36 is sized smaller than the other ridges 40, in the illustrative embodiment.

The engagement panel 34 of hair extension tool 10 is designed to be laid over and pressed into engagement with connector panel 32 as shown in FIG. 3. In some embodiments, engagement panel 34 may engage only a portion of hair extension 12. Engagement panel 34 is formed to include an engagement surface 58 and an outer surface 60 positioned opposite engagement surface 58 and extending between edges 24, 26, first side 28, and elbow 36. Engagement surface 58 is configured to engage hair extension 12 and is formed to include a plurality of depressions 38 defined by a plurality of ridges 40 extending between elbow 36 to first side 28 along upper edge 24 as shown in FIGS. 4 and 6. Outer surface 60 is formed to be facing away from the natural hair of the wearer 14. Illustratively, depressions 38 and ridges 40 extend a majority of upper edge 24 of engagement panel 34. As discussed above, first side 28 is coupled to parting needle 18 such that parting needle 18 extends away from engagement panel 34 and is configured to be used to create a part within the wearer's natural hair 16.

A majority of engagement surface 58 of engagement panel 34 is sized to extend a consistent height 52 from outer surface 60 along its length, as shown in FIGS. 4 and 6. The portion of engagement surface 58 having plurality of depressions 38 and ridges 40 formed therein is sized to extend a height 54 from outer surface 60 which is less than the aforementioned previous consistent height 52. Depressions 38, illustratively, have the same height 54 and are u-shaped, although other shapes may be used and are contemplated herein. Ridges 40 extend beyond the height 54 of the depressions 38 and are illustratively sized to be a height 56 between that of the consistent height 52 of support surface 48 and the height 54 of the depressions 38.

Depressions 38 are defined between ridges 40, as shown in FIGS. 4 and 6, and configured to engage hair extension 12 to assist in closure thereof, as shown in FIG. 3. Illustratively, five depressions 38 are formed in engagement surface 58 such that most are sized similarly. The depressions 38 positioned nearest elbow 36 and nearest first side 28 are sized smaller than the other depressions 38, in the illustrative embodiment. Plurality of depressions 38 are configured to engage a portion of hair extension 12 upon moving hair extension 12 into a closed position having some natural hair positioned therein, as shown in FIG. 3.

Additionally, as shown in FIGS. 4 and 6, depressions 38 may be formed to include an extension 62 formed within two of the depressions 38 located in the engagement surface 58. Such extensions, illustratively, extend the length of the depression 38 from upper edge 24 into engagement surface 58 such that it the length of extension 62 exceeds that of depressions 38. Further, the portion extending into engagement surface area 58 is sized to have the same height 54 as depressions 38 and include additional t-shaped depressions 64 formed therein.

Ridges 40 are, illustratively, rectangular in shape and formed to engage hair extension 12 such that once some of the wearer's natural hair 16 is positioned therein and hair extension 12 is in a closed position, as shown in FIG. 3, plurality of ridges 40 are positioned on top and in contact with of hair extension 12. Illustratively, four ridges 40 are formed in engagement surface 58 such that most are sized similarly.

Illustratively, and as shown in FIGS. 1-3, a user first uses parting needle 18 to create a part in the wearer's natural hair 16 and positions the connector panel 34 along the part such that upper edge 24 of the tool 10 is in line with the part, as shown in FIG. 1. The user then places hair extension 12 onto tool 10 such that hair extension 12 extends along the tool 10 and is fully positioned therein. Upon placing some of the wearer's real hair 16 into hair extension 12, the user places hair extension 12 in a closed position, as shown in FIG. 2. At this point, at least one side of hair extension 12 is engaged with connector panel 34 and prepared for coupling to the wearer's natural hair 16.

The user then moves tool 10 into a closed position as shown in FIG. 3 and applies pressure upon tool 10 such that hair extension 12 locks into place. In the closed position, engagement panel 34 and connector panel 32 engage hair extension 12 such that when a user applies pressure upon tool 10, the depressions 38 and ridges 40 formed therein convey this pressure upon hair extension 12 so to couple hair extension 12 to the wearer's real hair 16.

Once hair extension 12 is coupled to the wearer, the user may remove tool 10 by rotating engagement panel 34 about elbow 36 such that engagement panel 34 is spaced apart from connector panel 32 thereby allowing connector panel 32 to be slide out from behind hair extension 12. Illustratively, the user grips opener tab 42 and engagement panel 34 so to provide additional leverage for removal, if needed.

A second hair extension attachment tool 210 is shown in FIGS. 7-9 of the present disclosure. The second tool 210 is substantially similar to the tool 10 shown in FIGS. 1-6 and described above. Accordingly, the description of the tool 10 is hereby incorporated by reference to apply to the tool 210 except as it departs from the further description and drawings of the tool 210.

The hair extension attachment tool 210 differs from the tool 10 in that the engagement panel 234 is shaped to have a more rectangular shape as defined by an upper edge 224, lower edge 226, and first side 223 of clamp body 220. Illustratively, the first edge 228 is parallel to elbow 236 as shown in FIGS. 7 and 9. Further, support surface 248 of connector panel 234 includes a plurality of depressions 238 and an extension 262 formed therein and extending between lower edge 226 and upper edge 224. Illustratively, extension 262 is shaped such that an upper section 280 is sized to be wider than a lower section 282. Sections 280, 282 unite at a midline 284 formed in support surface 248. Engagement surface 258 is also formed to include a projection 286 extending upwardly away from support surface 248 and between lower edge 226 and midline 284. Illustratively, projection 286 aligns with a depression 238 and is configured to engage hair extension 12. Projection 286 is formed to include an aperture from which a pin 290 extends towards upper edge 224 and is positioned parallel to depression 238.

The hair extension attachment tool 210 differs from the tool 10 in that the second side 230 of the connector panel 232 forms a 90 degree angle with the lower edge 226 of the clamp body 220, as shown in FIGS. 7 and 8. Support surface 248 of connector panel 232 is a substantially flat surface but includes a plurality of evenly spaced ridges 240 extending between upper edge 224 and midline 284 thereby creating a plurality of depressions 238 therebetween. Additionally, engagement surface 258 is also formed to include a projection 286 extending upwardly away from engagement surface 258 and between lower edge 226 and midline 284. Illustratively, projection 286 aligns with a ridge 240 and is configured to engage hair extension 12. Projection 286 is formed to include an aperture 288 from which a pin 290 extends upwardly towards upper edge 224 and is positioned parallel to ridge 240.

Looking to FIGS. 7-10, pins 290 are configured to engage hair extension 12 such that it remains coupled to tool 210 until removal by the user. To explain, prior to coupling extension 12 with the wearer's hair, a user positions hair extension 12 along support surface 248 and engagement surface 258 such that pins 290 engage hair extension 12. The user opens tool 210 such that engagement surface 234 and support surface 258 are facing away from the wearer's natural hair 14 and positions hair extension 12 thereon. Illustratively, the user first couples an engagement strip 40 of hair extension 12 to engagement panel 234 by positioning the plurality of catches 72 of the hair extension 12 within depressions 238. In doing so, the user removeably couples pin 290 to engagement strip 40 of the hair extension 12 by inserting pin 290 within the extension 12. This couples the engagement panel 234 of the tool 210 to the extension 12 in preparation for coupling the remaining portion of the extension 12 to the tool 210 and, ultimately, coupling extension 12 to a wearer's natural hair 14.

Illustratively, the user then bends tool 210 at elbow 36 to a 45 degree angle and couples a connector strip 38 of extension 12 to connector panel 232 by positioning the plurality of lock teeth 74 of extension 12 within depressions 238 formed therein. In doing so, the user removeably couples pin 290 to the connector strip 38 of extension 12 by inserting pin 290 within the extension 12. This couples the connector panel 232 of the tool 210 to the extension 12 in preparation for coupling extension 12 to a wearer's natural hair 14.

Upon coupling extension 12 to tool 210, the user places engagement panel 34, 234 underneath a portion of the wearer's natural hair 14 such that at portion of the engagement panel 334 engages the wearer's head. The wearer's natural hair 14 is positioned between engagement panel 234 and connector panel 232 and tool 10 is configured to close thereon. When closed, tool 10 assists in coupling extension 12 to the wearer's natural hair 14 by reducing the necessary force to close tool 210, providing additional surface area for a user to grasp, and/or additional manners in easing the coupling of extension 12 to the wearer's natural hair 14. Following this coupling, the user slightly opens tool 10 to separate engagement surface 258 and support surface 248 and release pins 290 from extension 12. Tool 210 may then be slide off of the wearer's natural hair 14 while extension 12 remains coupled to wearer's natural hair 14.

A third hair extension attachment tool 310 is shown in FIGS. 11-13 of the present disclosure. The third tool 310 is substantially similar to the tool 10 shown in FIGS. 1-6 and the tool 210 shown in FIGS. 7-9 and described above. Accordingly, the description of the tool 10 and tool 210 is hereby incorporated by reference to apply to the tool 310 except as it departs from the further description and drawings of the tool 310.

The hair extension attachment tool 310 differs from the tools, 10, 210 in that the connector panel 332 and the engagement panel 334 has an extension portion 333, 335 which extends from an upper edge 324 of each panel 332, 334. A lower edge 326 positioned opposite to and spaced apart from the upper edge 324, while a first side 328 extends between the upper edge 324 and lower edge 326. A second side 330 is positioned opposite to and spaced apart from first side 328 and extends between the upper edge 324 and lower edge 326.

The extension 333 extends from the upper edge 324 of the connector panel 332, while the extension 335 extends from the upper edge 324 of the engagement panel 334. The extension 333 extends to an outer edge 337 and the extension 335 extends to an outer edge 339. The outer edges 337, 339 are equally spaced apart from the upper edges 324 of each panel 332, 334.

The extensions 333, 335 are shaped to include a plurality of depressions 338 and ridges 340 as shown in FIGS. 11-13. Further, the engagement surface 358 of connector panel 334 includes depression extensions 362, 363 formed therein. Each extension 362, 363 extends from the outer edge 339 of the extension 335 partway towards the lower edge 326. Each extension 362, 363 extends past the upper edge 224 which acts as a midline formed in engagement surface 358.

Illustratively, each extension 362, 363 has the same width from the depression 338 to the extension 362, 363. The first extension 362 has a first width, while the second extension 363 has a second width. In the illustrative embodiment, the second width of the second extension 363 is greater than the first width of the first extension 362.

Each of the connector panel 332 and the engagement panel 334 has a hook projection 392, 394 as shown in FIGS. 11-13. The hook projections 392, 394 are fastened to the respective panel 332, 334 with a fastener. The hook projection 392 on the connector panel 332 is coupled to the support surface 348 in a recess 396 that extends into the support surface 348. The hook projections 394 on the engagement panel 334 is coupled to the engagement panel 334 in the first extension 362.

The hook projection 392 is aligned with one of the ridges 340 as shown in FIGS. 11 and 12. When the tool is closed, the hook projection 392 is located in the second extension 363 formed on the engagement panel 334.

Additionally, attachment tool 10,210,310 may be made from a plurality of materials including, but not limited to, metal, plastic, composite materials, rubber, ceramic, and any other material known in the art.

The invention claimed is:

1. A hair extension attachment tool for integrating a hair extension into a person's head of hair, the tool comprising a parting needle with a free end, and a clamp body coupled to the parting needle at an end opposite the free end, the clamp body including an engagement panel fixed to the parting needle and a connector panel coupled to the engagement panel to pivot relative to the engagement panel from an opened position arranged adjacent to the engagement panel to a closed position arranged over the engagement panel, wherein the clamp body includes a hair extension mount means for temporarily holding a connector strip included in the hair extension during fixation of the connector strip to the person's head of hair, easing installation by allowing a stylist to interact with additional surface area available along the clamp body of the hair extension attachment tool rather than just the connector strip of the hair extension, wherein the hair extension mount means includes at least one projection assembly coupled to the connector panel and configured to slidingly engage the connector strip to retain the connector strip to the hair extension attachment tool during fixation of the connector strip to the person's head of hair and to disengage the connector strip after fixation of the connector strip to the person's head of hair, and wherein the clamp body includes a plurality of ridges spaced along the connector panel and the engagement panel and a plurality of depressions formed between the plurality of ridges, and wherein the at least one projection assembly is coupled to the connector panel to extend over one of the plurality of ridges.

2. The tool of claim 1, wherein the plurality of ridges are shaped to extend toward the other of the connector panel and the engagement panel when the connector panel is in the closed position so as to create press points where the connector strip of the hair extension is pushed together along the clamp body when the connector panel is in the closed position over the engagement panel.

3. The tool of claim 2, wherein each of the plurality of depressions is located to oppose a corresponding one or more of the plurality of ridges when the connector panel is in the closed position so that the press points are located between surfaces defining the plurality of depressions and the plurality of ridges.

4. The tool of claim 3, wherein the at least one projection assembly is a first projection assembly, and wherein the hair extension mount means further includes a second projection assembly coupled to the engagement panel and configured to slidingly engage the connector strip to retain the connector strip to the hair extension attachment tool during fixation of the connector strip to the person's head of hair and to disengage the connector strip after fixation of the connector strip to the person's head of hair.

5. The tool of claim 4, wherein the plurality of ridges is spaced along the connector panel, and wherein the first projection assembly is positioned to extend over one of the plurality of ridges.

6. The tool of claim 4, wherein the plurality of depressions is formed on the engagement panel, and wherein the second projection assembly is positioned to extend over one of the plurality of depressions.

* * * * *